US009021640B2

(12) United States Patent
Mohr

(10) Patent No.: US 9,021,640 B2
(45) Date of Patent: May 5, 2015

(54) VACUUM MATTRESS

(71) Applicant: Marion Mohr, Bonn (DE)

(72) Inventor: Marion Mohr, Bonn (DE)

( * ) Notice: Subject to any disclaimer, the term of this patent is extended or adjusted under 35 U.S.C. 154(b) by 0 days.

(21) Appl. No.: 14/092,313

(22) Filed: Nov. 27, 2013

(65) Prior Publication Data

US 2014/0143956 A1 May 29, 2014

(30) Foreign Application Priority Data

Nov. 27, 2012 (DE) ..... 10 2012 023 148

(51) Int. Cl.

| | |
|---|---|
| ***A47C 17/00*** | (2006.01) |
| ***A61G 7/057*** | (2006.01) |
| ***A47C 27/14*** | (2006.01) |
| ***A61G 13/12*** | (2006.01) |

(52) U.S. Cl.

CPC ..... *A61G 7/05738* (2013.01); *A47C 27/14* (2013.01); *A61G 7/05753* (2013.01); *A61G 13/1275* (2013.01)

(58) Field of Classification Search

CPC ... A47C 27/086; A61G 7/0526; A61G 7/103; A61G 7/05753

USPC ..... 5/644, 654, 910, 911, 913, 740, 5/625–629, 655.4, 924, 702; 128/870

See application file for complete search history.

(56) References Cited

U.S. PATENT DOCUMENTS

| | | | | |
|---|---|---|---|---|
| 4,428,087 | A | 1/1984 | Horn | |
| 5,121,756 | A * | 6/1992 | Koledin | 5/628 |
| 5,154,185 | A | 10/1992 | Latimer et al. | |
| 5,626,150 | A * | 5/1997 | Johnson et al. | 5/628 |
| 5,634,222 | A * | 6/1997 | Zwickey | 5/628 |
| 6,226,820 | B1 * | 5/2001 | Navarro | 5/655.5 |
| 6,401,283 | B2 * | 6/2002 | Thomas et al. | 5/740 |
| 6,912,749 | B2 * | 7/2005 | Thomas et al. | 5/713 |
| 8,690,807 | B2 * | 4/2014 | Hiebert | 602/13 |
| 2010/0186170 | A1 | 7/2010 | Hieronimi et al. | |
| 2011/0191960 | A1 * | 8/2011 | Hiebert | 5/615 |

FOREIGN PATENT DOCUMENTS

| | | |
|---|---|---|
| CH | 676924 | 3/1991 |
| DE | 4304518 | 8/1994 |
| DE | 69719125 | 2/1998 |
| DE | 10030161 | 7/2003 |
| DE | 102011114082 | 3/2013 |
| DE | 102012001363 | 7/2013 |
| EP | 0821928 | 2/2003 |
| WO | 2007147633 | 12/2007 |

* cited by examiner

*Primary Examiner* — Nicholas Polito
*Assistant Examiner* — Richard G Davis
(74) *Attorney, Agent, or Firm* — Thomas D. Wilhelm; Wilhelm Law, S.C.

(57) ABSTRACT

A vacuum mattress for an operation table has plural foam strips oriented longitudinally with respect to a patient, the foam strips being laterally spaced apart, wherein the gaps are free from granulate of the vacuum mattress at least in their upper parts and the plural foam strips are separated from the granulate by a gas-impermeable layer.

18 Claims, 6 Drawing Sheets

VACUUM MATTRESS

CROSS-REFERENCE TO RELATED APPLICATIONS

This application claims priority of Patent Application No. 10 2012 023 148.2, filed Nov. 27, 2012 in Germany, the entire contents of which are incorporated by reference herein, and which is an application for a patent of addition to Patent Application No. 10 2011 114 082.8, filed Sep. 21, 2011 in Germany, the entire contents of which are also incorporated by reference herein.

FIELD OF THE INVENTION

The invention relates to a vacuum mattress for use on a surgical operation table, in particular for fixing a patient in his or her momentary body position.

BACKGROUND OF THE INVENTION

A vacuum mattress known from patent document DE 100 30 161 C1 serves for transporting injured or ill persons. This and similar mattresses are used in surgical areas of hospitals for immobilizing patients to be operated as of recently.

It has been found, however, that when lying some time on the known mattresses, the patients develop pressure-caused irritations at the points of contact with the mattress.

It is therefore an aim of the present invention to provide a vacuum mattress allowing supporting a lying patient with reduced tendency to develop pressure-caused irritations, but with still sufficient position stabilization.

SUMMARY OF THE INVENTION

The invention, in one embodiment, provides a vacuum mattress in which foam inlays are provided in a common outer sheath together with granulate, wherein the foam strips are separated from the granulate by a gas-impermeable layer. In embodiments, the foam inlays are provided at least in a central part (with respect to the lateral direction) of that part of the mattress supporting the upper part of the body. In this manner, it is achieved that a padding is present which protects the patient from local pressures, while the foam inlays are not themselves compresses in the evacuation process. At the same time, the outer cover of the vacuum mattress remains smooth so that it can easily be cleaned or sterilized as the surgical operation environment may require.

In embodiments, one or more rigid foam inlays may be provided the stiffness of which still allows a modeling of the mattress to the body contour in the respective position the patient is in. The softer foam inlays used for padding may be made of reaction-cured foam.

In another embodiment, the vacuum mattress includes plural foam strips oriented longitudinally with respect to the patient, and mutually spaced apart laterally, wherein at least one interstice so formed is free of the granulate at least in an upper portion thereof, and wherein the plural foam strips are separated from the granulate by a gas-impermeable layer. When this aerated mattress is modeled to the patient's body and then is evacuated, the outer sheath bulges into the gaps or interstices, thereby forming channels in the upper surface of the mattress through which sweat or other body fluids may run off. At the same time, air may reach the patient's skin through these channels, allowing some cooling and thus enhancing the comfort provided.

In an embodiment, the granulate is accommodated in a textile bag to achieve this effect. In a further embodiment, the foam strips are arranged in a common gas-impermeable sheath such as a leatherette sheath. In a yet further embodiment, seams connecting an upper layer and a bottom layer of the sheath are formed e.g. by welding between adjacent foam strips.

In embodiments, cardboard strips or the like are arranged underneath one, several, or all of the foam strips as stabilizing elements counteracting a longitudinal compression of the vacuum mattress during evacuation. In other embodiments, the granulate is accommodated in a multi-chamber textile bag so that it remains evenly distributed even if the person lying on the mattress, prior to evacuating, moves.

In use the vacuum mattress is modeled to the body of the person lying on the aerated mattress, and is then evacuated so as to cling to the patient's body in his or her momentary position. This results in an inward-upward curving of the mattress which is desired for stabilizing the position of the patient. Because the radius of curvature at the upper side of the vacuum mattress facing the patient is smaller than the radius of curvature of the underside of the vacuum mattress facing away from the patient, longitudinal wrinkles are formed, which bulge into the interstices between adjacent foam strips, which interstices are kept at least partially free from granulate for this purpose. In this manner, undesirable wrinkles bulging outward (with respect to the mattress) are avoided. These channels serve to let sweat or other body fluids run off, which is particularly advantageous where electro scalpels are employed and any unintentional grounding of the patient must therefore be avoided.

BRIEF DESCRIPTION OF THE DRAWINGS

The foregoing as well as other advantageous features of the disclosure will be more apparent from the following detailed description of exemplary embodiments with reference to the accompanying drawings. It is noted that not all possible embodiments necessarily exhibit each and every, or any, of the advantages identified herein.

DETAILED DESCRIPTION OF THE ILLUSTRATED EMBODIMENTS

Figure 1:
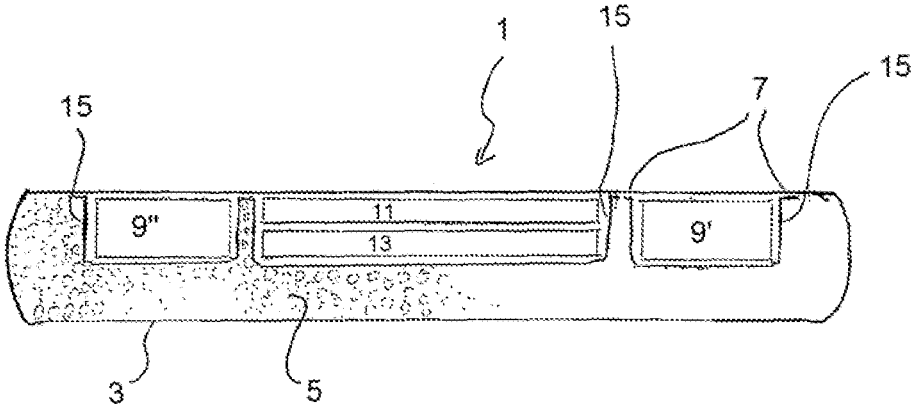
FIG. 1 shows a vacuum mattress with three welded-in foam inlays for padding, and a rigid foam inlay for stabilization in the central part in cross-section.

In the exemplary embodiments described below, components that are alike in function and structure are designated as far as possible by like reference numerals. Therefore, to understand the features of the individual components of a specific embodiment, the descriptions of other embodiments and of the summary of the disclosure should be referred to.

In FIG. 1, the reference numeral 1 indicates the vacuum mattress as a whole. Within a common sheath 3 made of leatherette, a granulate filling 5 and several foam inlays 9', 9", 11 and 13 are arranged, which are in turn enclosed by leatherette sheaths 15. The granulate 5 in the aerated state only partially fills the common sheath 3. In the drawing, the granulate is indicated only on one side. Padding foam inlays are arranged in the right 9' and left 9" side portions.

The padding foam of inlays 9', 9", 11, and 13 is soft and compressible under the weight of an adult human, so as to conform to the contours of the human body while giving support and stabilization to the body. The chemical composition of the foam can be any composition which is safe for use in direct contact with the human body. Such composition does, by definition, include a polymeric material, and may contain any of a wide variety of additives which are known in the art for modifying the physical or chemical properties of the resulting foamed polymer composition.

While a wide variety of chemical compositions, as well as additive packages, are thus available for use as the padding foam, polymer compositions of the family of polymers known as polyurethanes, are exemplary, though not limiting.

Measured density of the foam in terms of pounds per cubic foot (pcf) is less important than the actual performance properties of the foam in terms of softness, for comfort of the patient, and compressibility, for lateral stability of the patient. Thus the optimum, or desired, measured density of the foam varies depending on the chemical composition of the foam, as well as the affect of any additives in the foamed polymer composition.

Exemplary of foams which are acceptable for use herein are foams based on reaction-cured compositions known as polyurethanes, having densities of about 2 pcf to about 14 pcf, optionally about 4 pcf to about 10 pcf. The density can be greater than 14 pcf provided that the foam product provides the requisite softness and compressibility.

Given the fact that functional performance is more important than chemical composition and/or density, the foam can be either a reaction cured/thermoset foam, or a thermoplastic foam, and the density of the resultant foam product can be any density which provides the desired levels of softness, comfort, and lateral stability.

In the central portion in between a further padding foam inlay 11 is located, as well as, underneath it (i.e., facing away from the patient), a rigid foam inlay 13. In a variant, a cardboard layer or the like is used. The purpose of this rigid foam inlay, or other relatively harder and more supportive material, is to prevent the granulate from exerting a pressure on the patient during evacuating as well as to support the bone/skeletal structure, especially the back, of the patient when the mattress is in the evacuated state. This is because the vacuum mattress tends to shrink during evacuation, which would lead to a squeezing of the patient if it weren't for the rigid layer which is slightly resilient. The leatherette sheaths 15 enclosing the foam inlays 9', 9", 11 and 13 are welded 7 to the common outer sheath 3. The common outer sheath 3 made of leatherette, due to its smoothness, allows e.g. for a thorough disinfection as is particularly important in surgery.

Figure 2:
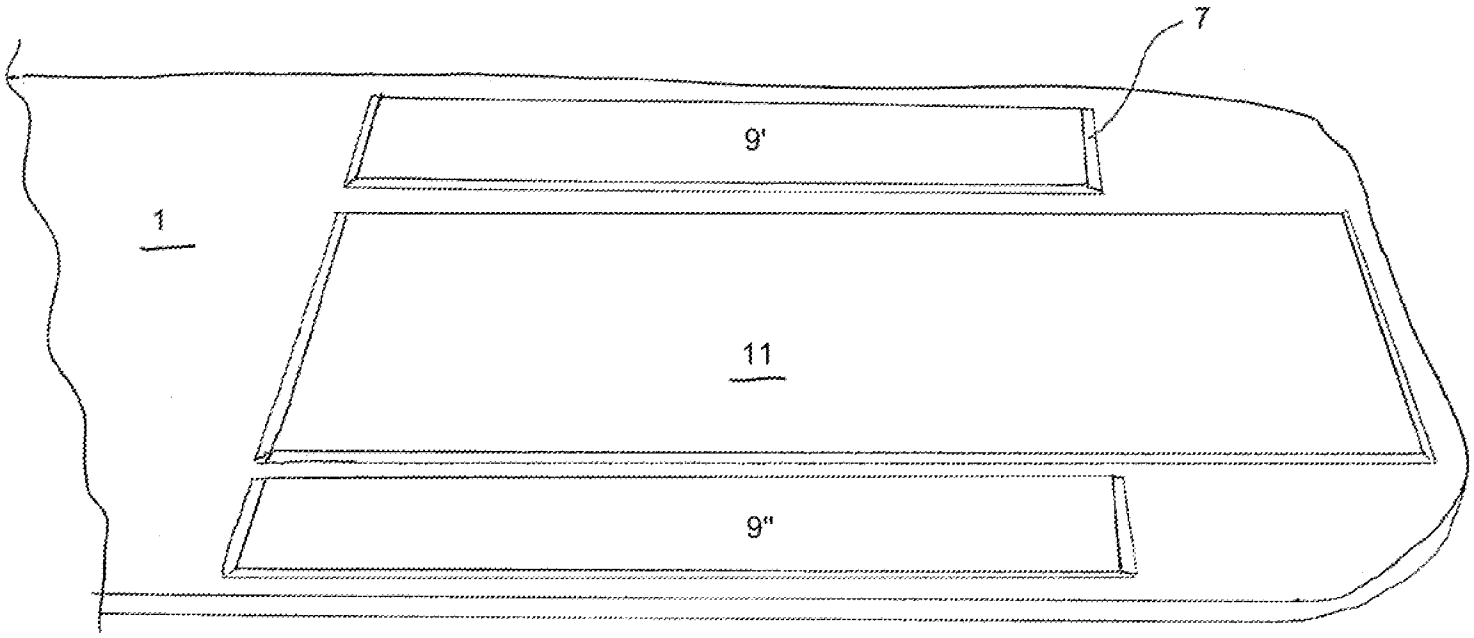
FIG. 2 shows a similar vacuum mattress in a perspective top view.

FIG. 2 shows only the part of the mattress 1 for the upper body part. Along the lengthwise center line, and within the mattress 1, the foam layer 11 is itself enclosed by a welded sheath, which is in turn welded 7 to the outer sheath 3. To both sides thereof, further foam inlays 9' and 9" are arranged, which are fixed in the same manner. Beneath the foam layer 11, and therefore not visible in this perspective top view, there is a stabilizing layer (reference numeral 13 in FIG. 1) such as a rigid foam layer or a cardboard layer. Other functional components required for a vacuum mattress, and known to the skilled person, are not shown for clarity.

Figure 3:
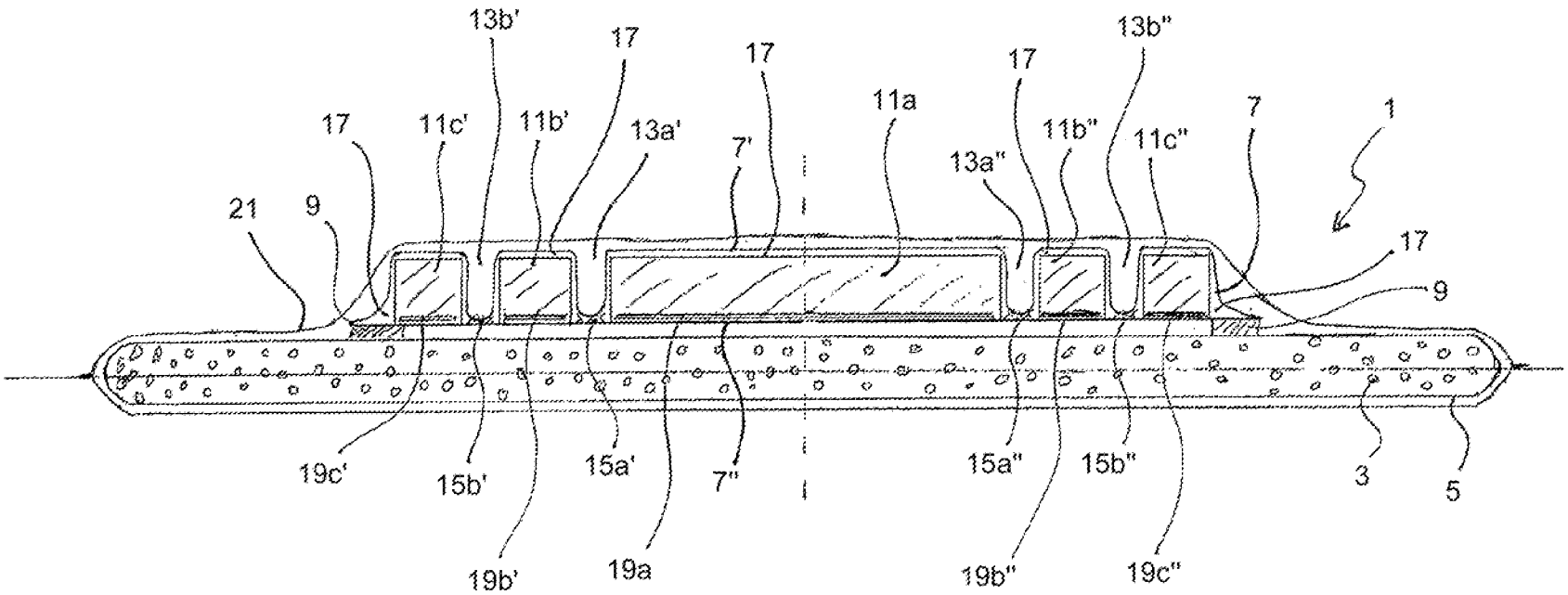
FIG. 3 shows a transverse cross-section of a vacuum mattress according to the invention in non-use.

In addition to the improvements described above, there is proposed another embodiment as follows: Namely, according to FIG. 3, a cross-section of an aerated, flat vacuum mattress 1 is shown. The granulate 3 is accommodated loosely in a textile bag 5. Above same, a leatherette sheath 7 is adhered partially or in full area, within which sheath several (in this example, five) foam strips 11*a*, 11*b*', 11*b*", 11*c*', 11*c*" are accommodated. The interstices or gaps between adjacent foam strips are kept free, in particular, from granulate. All the padding foam strips are accommodated in the common leatherette sheath 7. Below the interstices, the upper layer 7' of the leatherette sheath 7 is welded to the lower layer 7" of the leatherette sheath 7, thereby forming elongated pouches 17, in each of which one respective foam element is accommodated. Furthermore, beneath each of the padding foam elements, a stabilizing element 19*a*, 19*b*', 19*b*", 19*c*', 19*c*" is provided to enhance rigidity. These elements may be made of hard foam or e.g. of card board having a thickness of about 2-5 mm or about 3-4 mm. Their width is slightly (by up to about 10% or 20%) less than that of the corresponding foam strip; in terms of length, they extend over substantially the entire length of the corresponding foam strip, at least over about ¾ thereof. The textile bag with the granulate, and the leatherette sheath containing the foam strips, are both accommodated in the outer sheath 21 of the vacuum mattress. As a matter of course, same further includes the required components such as a valve which are not specifically shown. The center plane, indicated by a dashed line, represents a symmetry plane; the horizontal plane is indicated by a continuous line. The foam elements are indicated by hatching. It is reasonable to employ an odd number of these elements. The textile bag may contain several, e.g. 10-40 chambers.

Figure 4:
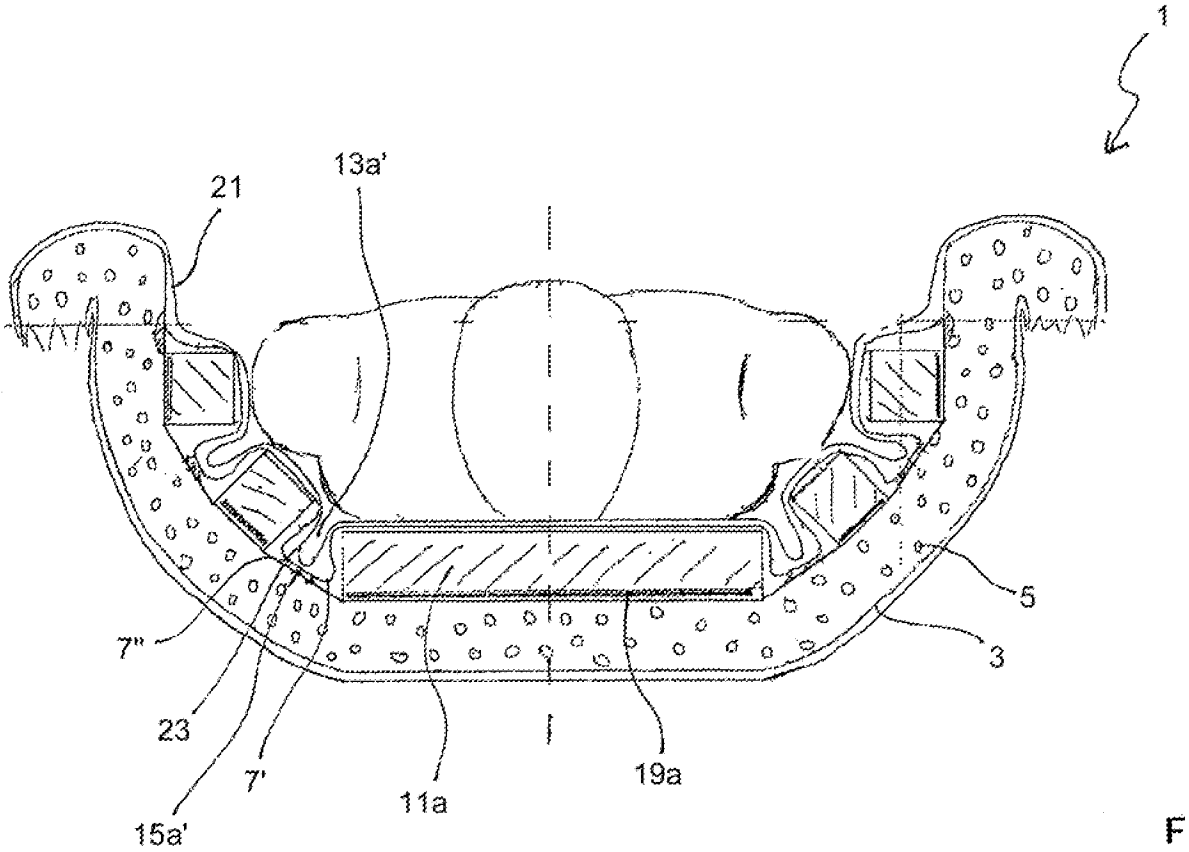
FIG. 4 shows the same vacuum mattress in use (in transverse cross-section.

FIG. 4 shows the same vacuum mattress 1 with a patient lying on the mattress, after the mattress has been evacuated (in-use case): The vacuum mattress 1 now nestles to the patient's body from its sides. On the inner side of the curved portion, the upper layer 23 therefore bulges into the free interstices 13*a*' etc. and forms lengthwise channels. At the opposite, lower side of the vacuum mattress, the outer sheath tightly surrounds the slightly larger radius there. In the lengthwise direction, the vacuum mattress is largely free from shrinking (less than about 2%, or) 1%), because the stabilizing elements 19*a* etc. take up the pressure in this direction. There is a thickness reduction, which is not drawn to scale; furthermore, the granulate particles 3 (made of polystyrene foam or the like) cling to one another on evacuation. Such foam granulate may be similar or identical to the particulate foam products, sometimes called "peanuts", or other common descriptors, which are commonly sold, and used inside e.g. cardboard boxes, to cushion other, more valuable, contents during shipping.

The foam strips can be made of reaction-cured foam or the like.

This vacuum mattress reduces lengthwise stress acting on the patient, and thereby enhances comfort. The purposive channels avoid the formation of wrinkles bulging upwards, which might irritate the patient. On the contrary, the wrinkles forming upon evacuating will bulge downwards, forming channels through which sweat or the like can be purged, reducing the danger of burns from an electro-scalpel. Furthermore, the channels provide air access and thereby reduce sweating and enhance comfort for the patient.

Figure 5A:
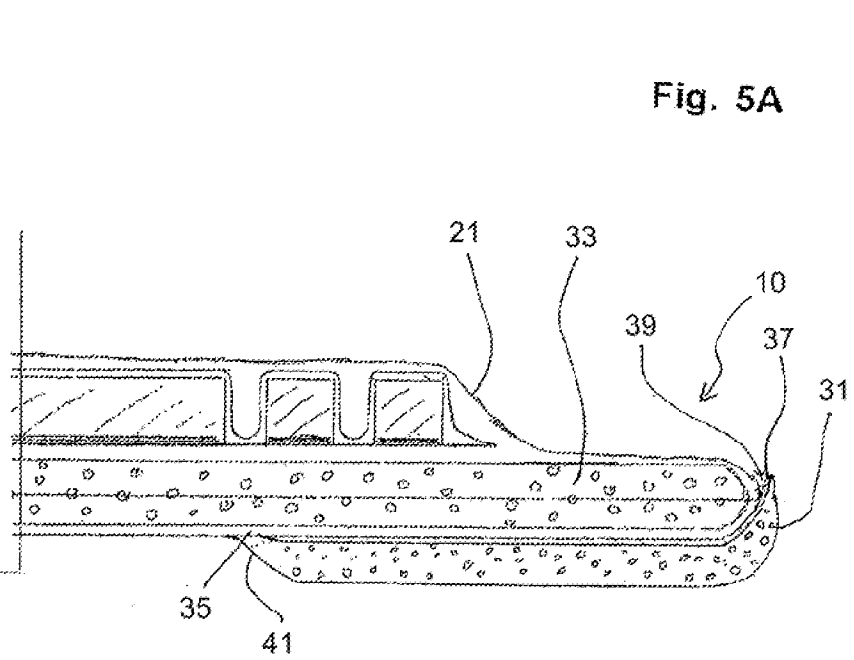
FIG. 5A shows a right half of a modified vacuum mattress in non-use (in transverse cross section)
Figure 5B:
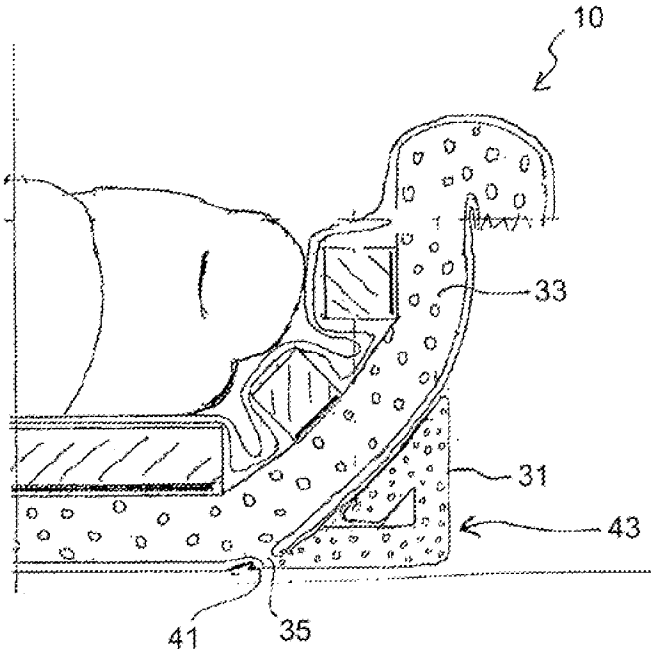
FIG. 5B shows the same half in use (in transverse cross-section)

In the further improvement according to FIG. 5A (only the right halt with respect to the symmetry plane being shown), on the underside of the vacuum mattress 10, on either side gas-impermeable protrusions 31 are formed, the interior of which is partially filled with granulate, and is connected 35 gas-permeably, and therefore evacuatably with the interior 33 of the main part of the vacuum mattress. At its outer rims 37, the protrusions (of which only the right one is shown) are releasably attached to the outer sheath 21 of the vacuum mattress, e.g. by means of push-buttons 39. It is suitable to provide the inner rim 41 in a region located at about 20%-40% of the total width from the outer rim 37. In use (FIG. 5B), the protrusion 31 are folded or rolled inwardly during modeling, shortly before evacuating the mattress. When the mattress is next evacuated, the inwardly folded or rolled protrusion are likewise evacuated, and compressed, and form lengthwise rolls 43 preventing a sideways motion of the patient even if having a high center-of-mass, or if large lateral forces act in the course of the surgical operation.

The vacuum mattress consists of the components of the multi-chamber inlay with the granulate filling, and the foam segment arrayed on top of same. The individual foam segments are placed lengthwise at 2-3 cm distance onto the granulate-filled multi-chamber textile inlay. In the modeled, evacuated state of use, the surface material of the vacuum mattress will bulge inwards into the gaps to form downward wrinkles. Potentially irritating upward wrinkles are thus suppressed. This is particularly advantageous for avoiding pressure sores.

In view of the important aspect of hygiene, it is important to note that the mattress according to the invention may be readily cleaned on both its upper and lower side because of its smooth respective surfaces, be it in the evacuated or non-evacuated state.

The additional foam inlays elevate the center of mass of the patient somewhat. In particular with overweight patients, an issue may arise that the body mass tends to fall to either side. In the modeled, evacuated state of the mattress, its footprint is narrower and the mattress therefore apt to rocking and insofar becoming potentially unstable. The protrusions at its underside, formed into stabilizing wedges (see FIG. 5B), may reduce this risk substantially.

The vacuum mattress described above is used in the following manner: The patient is positioned on the aerated mattress, which is then modeled to the body contour. Then, the vacuum mattress is evacuated by sucking out the air between the granulate particles using, e.g., a pump. Thereby, the outer ambient pressure presses the granulate particles tightly together, so that the particles are fixed in their instant position. In this process, a compression of the foam is, however, impeded by the gas-impermeable layer. Thereby, the patient is fixed in his or her momentary body position in such a manner that he or she is lying on a padded portion with his or her most endangered body parts. In embodiments, the upper layer of the vacuum mattress forms one or more channels at the side on which the patient is lying by intruding into gaps formed between the plural foam inlays. In further embodiments, before the evacuating step, a protrusion formed at the underside of the mattress is folded towards its center to subsequently form a stabilizing feature.

Figure 6A:
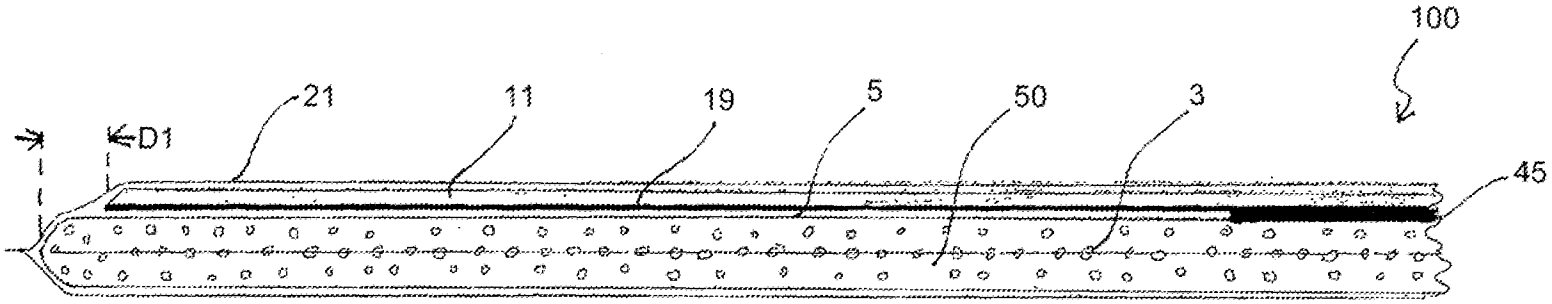
FIG. 6A shows a longitudinal cross-section of a feet-end portion of a vacuum mattress with partial-length attachment of the foam strip(s) to the granulate, in a state before evacuation.
Figure 6B:
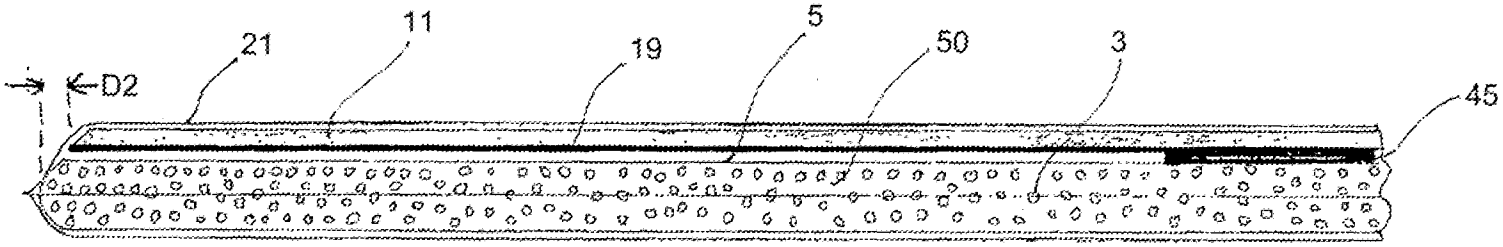
FIG. 6B shows a longitudinal cross-section of the same portion of the vacuum mattress as FIG. 6A, in a state during evacuation.

On some occasions, there may still occur wrinkles due to some remaining lengthwise contraction of the mattress during evacuation. In order to reduce this effect, in a further modified embodiment shown in FIGS. 6A and 6B, the cardboard element 19 used for stabilizing is not attached to the underlying gas-impermeable sheath 5 over the full length, but only in a reduced section 45 of about one quarter to one half of the full length, located nearer to the head-end of the mattress 100. This means that the shrinking of the granulate-filled lower part 50 of the vacuum mattress 100 will not be transferred to the upper, foam-padded part 11. Instead, the upper part will retain its original length, so that no wrinkles will be formed on the upper surface 21. The lower part is made initially somewhat longer than the upper part, so that after evacuation, both parts have about the same length. This effect is shown in FIGS. 6A (state before evacuation) and 6B (state after evacuation): As is readily discernible, the foot-end rims (left side) are more similar in length after evacuation (D2; FIG. 6B) than before (D1; FIG. 6A). The shrinkage effect is small but noticeable for the patient, as even small wrinkles will produce an irritating effect during lengthy surgical procedures.

While the invention has been described with respect to certain exemplary embodiments thereof, it is evident that many alternatives, modifications and variations will be apparent to those skilled in the art. E.g., in the above described embodiments, leatherette is employed as the surface material of the vacuum mattress. The skilled person will, however, be aware that other smooth, gas-impervious materials may likewise be used. Accordingly, the exemplary embodiments of the disclosure set forth herein are intended to be illustrative and not limiting in any way. Various changes may be made without departing from the spirit and scope of the present disclosure as defined in the following claims.

What is claimed:

1. A vacuum mattress, comprising one or more foam inlays for padding, wherein said vacuum mattress includes a granulate, and wherein granulate and said one or more foam inlays for padding are arranged in a sheath, wherein said one or more foam inlays for padding are separated from said granulate by a gas-impermeable layer, further comprising an underside protrusion, containing granulate, and wherein said underside protrusion, at an outer rim thereof, is releasably fixed to an outer rim of said vacuum mattress, and wherein an inner rim of said underside protrusion is gas-permeably connected to a main portion of said granulate.

2. The vacuum mattress of claim 1 wherein said gas-impermeable layer is welded to said sheath at a periphery of said one or more foam inlays for padding.

3. The vacuum mattress of claim 1 wherein at least one of said sheath and said gas-impermeable layer is formed from leatherette.

4. The vacuum mattress of claim 1 wherein ones of said foam inlays for padding are arranged in side portions of said vacuum mattress.

5. The vacuum mattress of claim 4 wherein a first one of said foam inlays for padding is arranged in a right side portion of said vacuum mattress and a second one of said foam inlays for padding is arranged in a left side portion of said vacuum mattress.

6. The vacuum mattress of claim 1 wherein one of said foam inlays for padding is disposed in a central portion of said vacuum mattress, and wherein said central portion is located between side portions of said vacuum mattress.

7. The vacuum mattress of claim 6, further including a rigid foam inlay, wherein said rigid foam inlay is arranged below the one of said foam inlays for padding which is arranged in the central portion of said vacuum mattress.

8. The vacuum ma of claim 1, further including a rigid foam inlay.

9. The vacuum mattress of claim 1 wherein said one or more foam inlays for padding are formed of reaction-cured foamed polymeric material.

10. The vacuum mattress of claim 1 wherein said granulate comprises polystyrene.

11. A vacuum mattress, comprising plural foam strips for padding oriented longitudinally with respect to a patient, wherein said vacuum mattress includes a granulate, and wherein said plural foam strips for padding are spaced apart with at least one interstice between first and second ones of said plural foam strips for padding, wherein said at least one interstice is free of said granulate in an upper portion of said at least one interstice, and wherein said plural foam strips for padding are separated from said granulate by a gas-impermeable layer, further comprising an underside protrusion, containing granulate, and wherein said underside protrusion, at an outer rim thereof, is releasably fixed to an outer rim of said vacuum mattress and wherein an inner rim of said underside protrusion is gas-permeably connected to a main portion of said granulate.

12. The vacuum mattress of claim 11 wherein said granulate is accommodated in a gas-pervious sheath chambered textile sheath.

13. The vacuum mattress of claim 11 wherein said plural foam strips for padding are accommodated in a gas-impermeable sheath.

14. The vacuum mattress of claim 13 wherein seams connecting an upper side sheath layer and a bottom side sheath layer are formed between adjacent ones of said plural foam strips for padding.

15. The vacuum mattress of claim 14 wherein said outer sheath during non-use smoothly covers an upper side of said vacuum mattress.

16. The vacuum mattress of claim 11 wherein at least one longitudinally-extending stabilizing element is disposed below at least one of said plural foam strips for padding for reducing a lengthwise compression of said vacuum mattress during evacuation.

17. The vacuum mattress of claim 16 wherein said at least one stabilizing element a cardboard strip, said cardboard strip extending along at least three quarters of a length of an associated one of said plural foam strips for padding.

18. A vacuum mattress, comprising at least one foam inlay for padding, and a rigid stabilizing element, wherein said vacuum mattress includes a granulate, and wherein said granulate, said rigid stabilizing element, and said at least one foam inlay for padding are arranged in a sheath, wherein said at least one foam inlay for padding and said stabilizing element are separated from said granulate by a gas-impermeable layer, and wherein said rigid stabilizing element is fixed to said gas-impermeable layer further comprising an underside protrusion, containing granulate, wherein said underside protrusion, at an outer rim thereof, is releasably fixed to an outer rim of said vacuum mattress, and wherein an inner rim of said underside protrusion is gas-permeably connected to a main portion of said granulate.

* * * * *